United States Patent [19]

Hughes

[11] 4,057,008

[45] Nov. 8, 1977

[54] CARTON ERECTING APPARATUS

[75] Inventor: Charles C. Hughes, Ludlow, Ky.

[73] Assignee: R. A. Jones & Co. Inc., Covington, Ky.

[21] Appl. No.: 723,992

[22] Filed: Sept. 16, 1976

[51] Int. Cl.[2] ..... B31B 1/52

[52] U.S. Cl. ..... 93/53 BF; 93/53 R

[58] Field of Search ..... 93/53 M, 53 R, 53 BF, 93/53 SD, 49 R; 53/186

[56] References Cited

U.S. PATENT DOCUMENTS

| | | | |
|---|---|---|---|
| 2,890,560 | 6/1959 | Nigrelli et al. | 93/53 R X |
| 2,989,903 | 6/1961 | Wilcox | 93/53 M |
| 3,104,598 | 9/1963 | Davies | 93/53 BF |
| 3,476,023 | 11/1969 | Fuller et al. | 93/53 R X |
| 3,476,024 | 11/1969 | Deering et al. | 93/53 R |
| 3,534,667 | 10/1970 | Krause | 93/53 BF |

*Primary Examiner*—James F. Coan

*Attorney, Agent, or Firm*—Wood, Herron & Evans

[57] ABSTRACT

Method and apparatus for erecting cartons wherein a flat folded carton blank is conveyed to the apparatus where it is momentarily stopped. Suction cups pull the under side of the blank downwardly against a breaker bar to bow the under side downwardly pulling the leading and trailing ends of the blank toward each other and thus bowing the upper carton side upwardly. With the carton thus partially opened, an overhead opening element rotates into engagement with a trailing side panel of the carton to swing it through an arc of about 90° until it is substantially vertical. An overbreak element thereafter engages the now vertical trailing side panel and swings it through another 90° to overbreak the carton. In this condition, the carton is conveyed out of the erecting apparatus and into transport lugs of the transport conveyor of a cartoner.

9 Claims, 6 Drawing Figures

CARTON ERECTING APPARATUS

This invention relates to a method and apparatus for erecting tubular cartons, and more particularly, the invention is an improvement in carton erecting of the type disclosed in U.S. Pat. No. 3,476,024.

In U.S. Pat. No. 3,476,024, a flat folded tubular carton blank is fed from a magazine in flat folded condition and conveyed to an erecting station. The carton blank has top and bottom panels interconnected by leading and trailing side panels, the leading panel facing upwardly and the trailing panel facing downwardly. The axis of the tubular carton is transverse to the direction of movement from the magazine through the erecting station to the transport conveyor. At the erecting station, which is ahead of a transport conveyor having spaced upwardly-directed lugs into which the cartons are to be fed, the carton blank is held stationary momentarily. A knife is projected transversely into each end of the carton where it partially opens the carton (about ¼ inch). Each knife has an edge which lies adjacent to the crease interconnecting the trailing side panel with the bottom panel. A cam-operated finger is caused to move upwardly into engagement with the trailing side panel to start to swing the trailing side panel toward a vertical position. When the trailing side panel begins to swing upwardly, a trailing pair of lugs in the transport conveyor swings up behind the carton blank and completes the raising of the trailing side panel to a vertical orientation. As the trailing side panel swings to vertical, it effects the erection of the carton to a rectangular form.

The mechanism of U.S. Pat. No. 3,476,024 performs the erecting operation satisfactorily but has two disadvantages which the present invention overcomes. First, the erecting apparatus requires a complex cam-operated erecting finger and further requires a complex mechanism for the knives which must be projected into the carton and then out of the carton before the transport lugs carry the carton away from the erecting station. The second disadvantage is related to the first in that the requirement of projecting knives into and out of the carton necessarily imposes a limiting factor on the number of cartons per minute which can be cycled through the machine.

An objective of the present invention has been to provide an improved carton erecting apparatus which is considerably less complex than those employed heretofore and which permits the speed of carton erecting to be substantially increased.

One feature of the invention resides in the utilization of a rotary opening element overlying the carton. The overhead opening element is mounted on a shaft and projects radially from one side of the shaft. The carton blank is adapted to pass under the element and shaft when the element is in an upwardly projecting attitude. When the carton blank comes briefly to rest, the rotating element swings underneath the trailing side panel and swings it from a horizontal to a vertical attitude thereby effecting the erection of the carton.

The overhead opening element can be used in conjunction with the reciprocating knives of the type employed in U.S. Pat. No. 3,476,024 thereby improving the erecting apparatus to the extent of eliminating the cam-operated erecting finger.

The erecting operation is further significantly improved by substituting for the reciprocating knives a suction cup and breaker bar combination to effect the partial opening of the carton. More specifically, underlying the carton blank at the location where the carton blank is momentarily stopped for the erecting operation, a transverse breaker bar is engageable by the under side of the carton at the crease between the bottom panel and trailing side panel. A plurality of transversely spaced suction cups, which are stationary, are disposed alongside the breaker bar. When vacuum is applied to the suction cups, the lower side of the carton is bowed slightly downwardly around the breaker bar. As the lower side of the carton, consisting of the bottom panel and trailing side panel, is bowed downwardly, the upper portion of the carton, consisting of the top panel and leading side panel, tends to move upwardly away from the bottom panel and trailing side panel, thus partially opening the carton. Thereafter, when an overhead opening element swings into engagement with the trailing side panel, the trailing side panel is swung to a vertical attitude to erect the carton.

The invention further contemplates the provision of a second rotating element for "overbreaking" the carton blank. It is similar to the opening element and is operative to swing into engagement with the generally vertically oriented trailing side panel and swing it through another 90° thus folding the carton over through 180°. When the carton is in the overbreak attitude, it may be fed by conveyors into the transport lugs of a cartoning machine and, having been overbroken, it is easier to handle, that is to say, it resists the tendency to return to its original flat folded condition. Further, the tendency of the carton to return to a more upright attitude may be utilized in conveying the carton out of the erecting station as will appear below.

Another feature of the invention resides in the fact that with the erecting apparatus of the present invention cartons may be fed more closely spaced into the cartoner than is possible with the erecting apparatus of U.S. Pat. No. 3,476,024. In the patented apparatus, because the trailing transport lugs participate in the erecting operation, sufficient space must be left between flat folded blanks to permit a leading carton to be erected by the transport lugs and conveyed away before the next incoming carton can be brought into position for the erecting operation. It is contemplated that in the present invention the cartons will be completely erected and preferably overfolded before their advance to the transport conveyor. Therefore, the only spacing requirement is that the cartons be spaced apart when erected at least by the height of the side panels.

The several objectives and features of the invention will become more readily apparent from the following description taken in conjunction with the drawings in which.

Figure 1:
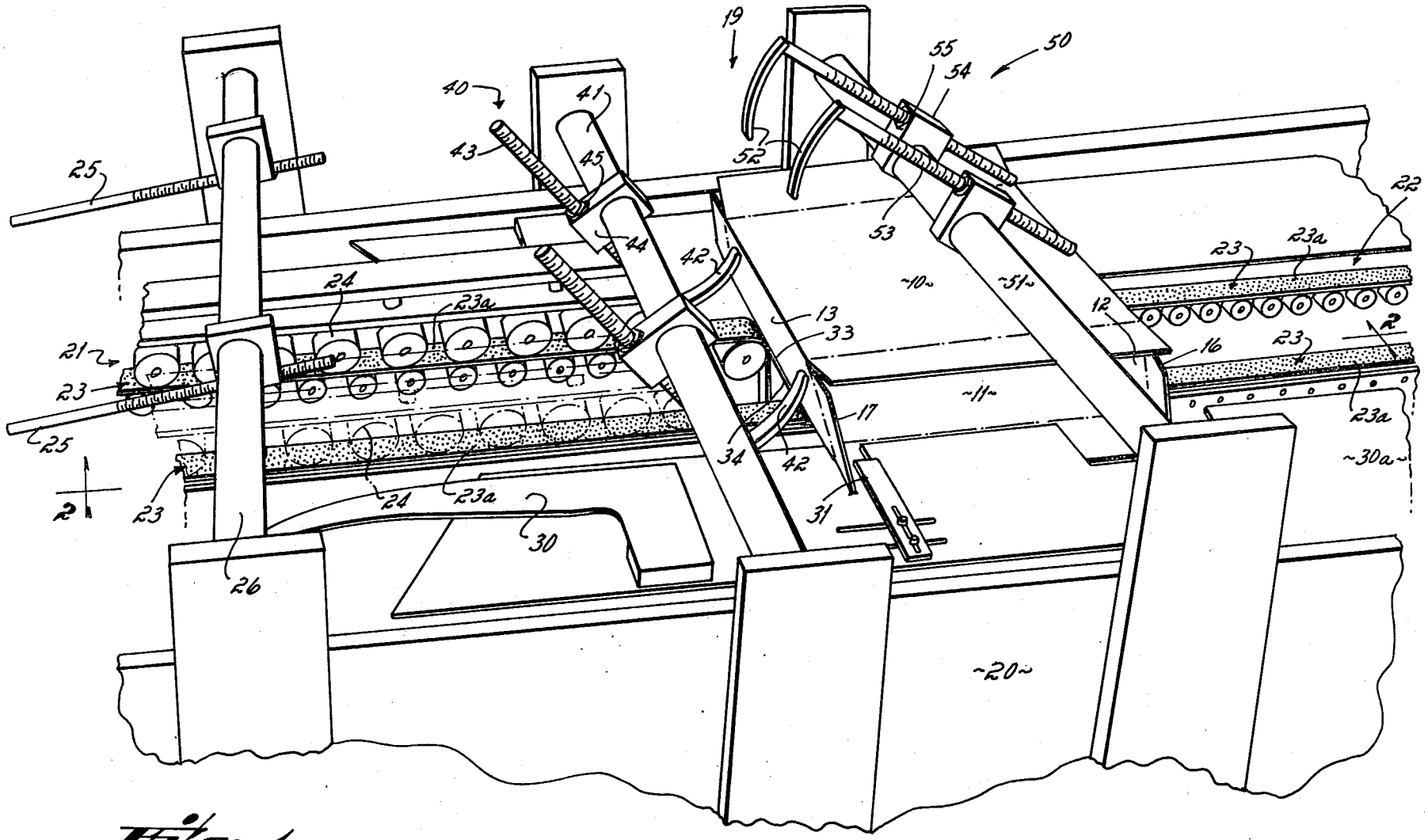
FIG. 1 is a perspective view of the carton erecting apparatus constructed in accordance with the practice of this invention.

A flat folded carton blank (not shown) which is to be erected by the apparatus of the present invention is illustrated in FIG. 1 as an erected carton. It can be seen that the carton has a top panel 10, a bottom panel 11, a leading upwardly-facing side panel 12 and a trailing downwardly-facing side panel 13. A flap 14 is hinged to each end of the top panel, a flap 15 is hinged to each end of the bottom panel, a flap 16 is hinged to each end of the leading panel, and a flap 17 is hinged to each end of the trailing side panel.

The erecting apparatus of the invention includes a frame 20 carrying an upstream conveyor section 21 and a downstream conveyor section 22. Each conveyor section is formed in part by two continuously running, transversely spaced, endless belts 23. The belts have an upper reach **23*a* which is interrupted at the erecting station, indicated generally at 19, by passing downwardly under rolls 23*b*, thereby dividing the belts into upstream and downstream sections. The upstream section which carries the blanks in a flat folded condition includes overlying rollers 24 which press the carton blank against at least one of the endless belts 23** to provide the frictional engagement of the blank with the endless belt to move it into the erecting section.

Figure 3:
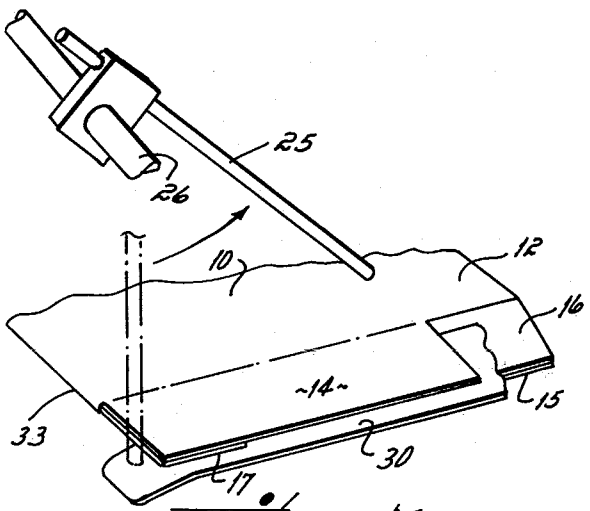
FIG. 3 is a diagrammatic perspective of a portion of the apparatus illustrating a flap engaging finger and a flap plow.

Overlying the upstream section are a pair of flap-engaging fingers 25 mounted on a rotatable shaft 26. The fingers 25 are operable to engage leading flaps 16, forcing them against flaps 15 on the bottom panel, thereby creating a slight spacing between top flaps 14 and bottom flaps 15. Some cartons are constructed with cutouts in flap 16 to permit direct engagement of flap 15 by the fingers 25 since it is necessary only to depress flap 15. A stationary plow 30 on each side of the apparatus passes into that slight spacing, over the flaps 15 and 16 and underneath the flaps 14, as the carton is moved into the erecting section (FIG. 3).

At the erecting section 19 a pair of adjustable stops 31 are mounted on the frame and project upwardly slightly in a position to engage the trailing flaps 17 at each side of the carton, thereby to precisely position the carton in the erecting station. The stops 31 are longitudinally as well as transversely adjustable in order to accommodate different carton sizes and to assure the positioning of the crease 33 between the bottom panel and trailing side panel of a carton precisely on the corner of a breaker bar 34 which is fixedly mounted to the frame and extends transversely across the frame at the erecting section. As obvious to those skilled in the art, stops 31 may alternately be positioned to engage other flaps of the carton construction.

Immediately downstream of the breaker bar 34 are a plurality of suction cups 35 (which may also be of a bellows type) which are stationary and which have upwardly flaring lips 36. The lips 36 are very flexible and flex downwardly when they are in engagement with the underlying surface of a carton blank and have suction applied to them. That downward flexing causes the under side of the carton to be drawn downwardly to effect partial opening of the carton, as will be explained in more detail below. A second transverse breaker bar similar to bar 34 may be employed at the downstream side of the suction cups to assist in the partial opening of short (machine direction) carton blanks.

Overlying the upstream conveyor section 21 is a pair of L-shaped opening elements 40 transversely spaced on a rotatable shaft 41. Each opening element 40 has a finger 42 adapted to engage the trailing side panel 13 to swing it upwardly. The finger 42 is mounted on a threaded rod 43 which is secured to a bracket 44 fixed on the shaft 41. A pair of nuts 45 permits the radial extension of the rod 43 and with it the finger 42 to be adjusted with respect to the shaft 41. The brackets 44 are axially positionable with respect to the shaft 41 to accommodate them to varying size cartons.

Overlying the downstream conveyor section 22 is a pair of overbreak elements 50 very similar to the opening elements 40. The overbreak elements are mounted on a rotatable shaft 51, each consisting of a finger 52 mounted on a rod 53 which is adjustably mounted on a bracket 54 fixed to the shaft 51. The rod 53 is threaded and is adjustably secured to the bracket by a pair of nuts 55. The transverse spacing of the overbreak elements 50 is closer than the spacing of the opening elements 40 so that they can pass each other without interference during the operation of the apparatus.

Figure 5:
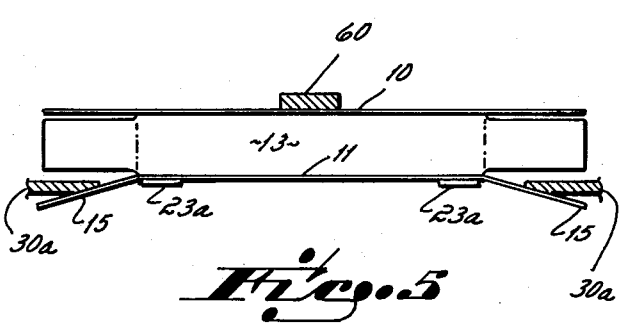
FIG. 5 is a cross-sectional view taken along lines 5—5 of FIG. 2.
Figure 4:
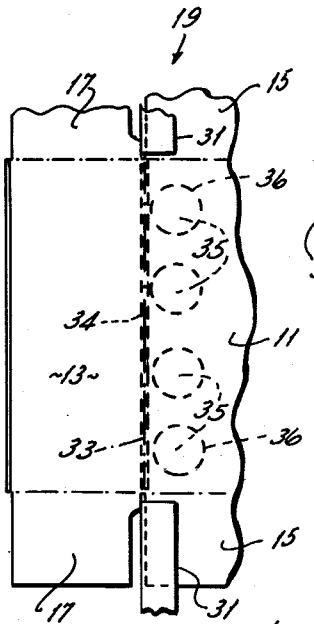
FIG. 4 is a cross-sectional view taken generally along lines 4—4 of FIG. 2.

Overlying the downstream section of the conveyor 22 is a guide rail 60 which is spaced above the upper run **23*a* of the belt 23 by a distance slightly less than the height of the side panels. In this form of the invention, the carton, when overbroken and thrust under the rail 60, will tend to spring up against the rail 60. The "fight" of the carton, that is, its resilience, tends to bias the bottom panel 11 against the upper run 23*a* permitting the carton to be conveyed away from the erecting station and into transport lugs of a conveyor (not shown). Additionally, extensions 30*a* of the plows 30 may overlie the flaps 15 to aid in holding the carton against the upper run 23*a* (FIG. 5**).

Alternatively, it may be desired in some cartoning operations to feed a carton, which has been overfolded through 180°, into a nip between the belts 23 and overlying rollers which convey the carton toward the transport lugs in a flat overfolded condition.

Means are, of course, provided for driving the conveyor belts 23, for rotating the shafts 26, 41 and 51, respectively, and for applying a vacuum to the suction cups all in timed relation. These means are shown only diagrammatically for the sake of clarity.

In the operation of the invention, flat folded blanks having an upwardly-facing leading side panel 12 and a downwardly-facing trailing side panel 13 are fed from a magazine (not shown) to the upstream conveyor section 21. In moving toward the erecting station, the flap-engaging fingers 25 briefly engage the leading flaps 16 to press them downwardly, and along with it flaps 15 on the bottom panel 11 below the surface of a stationary plow 30. As the blank moves downstream into the erecting section, the trailing flaps 17 ride above the plow and into engagement with the stops 31. Upon engagement with the stops 31, the blank is momentarily held in the proper position for erecting. In this position the trailing crease 33 between the bottom panel and trailing side panel precisely overlies the upper corner of the breaker bar 34. At this time vacuum is applied to the suction cups 35 which draws the bottom panel downwardly with respect to the breaker bar at one end and the conveyor at the other end. The bowing of the bottom and trailing side panel slightly shortens the distance between the leading and trailing edges of the carton blank, thereby causing the top panel and leading side panel to bow slightly upwardly. That slight bowing, creating a gap of approximately ¼ inch between top and bottom panels, is all of the partial opening that is required to provide assurance that the carton will erect properly when it is engaged by the opening element.

As soon as suction is applied, the rotatable opening element 40 swings up under the trailing side panel 13 to swing it to a substantially vertical position through an angle of approximately 90°. As the trailing side panel 13 is held momentarily in the vertical attitude, the overbreak element 50 rotates into engagement with the trailing side panel, forcing it in a downstream direction through another 90° thereby overbreaking the carton blank through a total of 180°. By modifying the shape or position of opening element 40, the trailing flap may be swung through substantially less than or greater than 90°, all of which would depend on a specific carton design.

When the trailing side panel is swung upwardly, the upward movement of the panel will carry with it its hinged flaps stops 31. Upon removal of the vacuum at this time, the endless belts 23 are able to continue the movement of the carton blank in a downstream direction.

As the carton blank moves downstream, it slides under guide rail 60 and is then released by passing beyond the overbreak element 50. When released, the carton blank will flex upwardly and its "fight" will bias the top panel 10 against the guide rail 60. This biasing arising out of the resilience of the board from which the blank is formed forces the bottom panel against the belts 23 so that the belts 23 can continue to move the now opened carton blanks in a downstream direction.

Immediately adjacent the downstream end of the belts 23 the carton blanks will be discharged between the leading and trailing transport lugs of a known cartoner, which is not shown.

Figure 2:
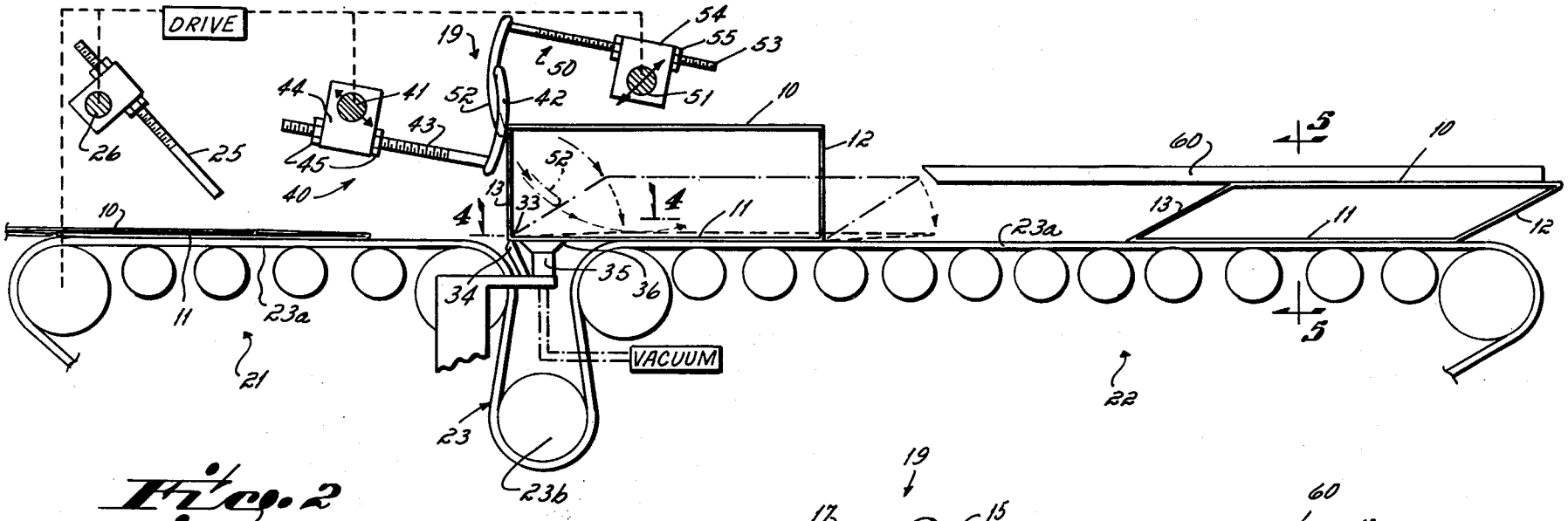
FIG. 2 is a diagrammatic cross-sectional view taken generally along lines 2—2 of FIG. 1.

It can be seen especially from FIG. 2 that the incoming stream of cartons is spaced substantially end-to-end, this close spacing being permitted by the fact that the erecting apparatus does not rely on the upward swing of the cartonertransport lugs to effect the erecting of the blanks. Thus, the carton blanks can be very closely spaced when fed into the cartoner, the blanks being separated by a minimum distance equal to the height of the side panels, thereby providing economy of space and efficiency in the cartoning operation.

In the preferred embodiment of the invention, the blanks are partially opened by the suction cups 35 and cooperating breaker bar 34. In another form of the invention, the suction cup and breaker bar mechanism for partial opening of the blanks is replaced by the reciprocating knives of the type shown in U.S. Pat. No. 3,476,024. That embodiment is illustrated diagrammatically in FIG. 6. There the cartons are fed toward the erecting apparatus from a magazine (not shown), and the end flaps are plowed slightly open as described above. As the carton blanks move into the erecting apparatus, the reciprocating knives 70 move into the carton blank from each end and form an internal stop with the upstream end of the knives lying adjacent to the crease between the bottom panel and the trailing side panel.

Upstream of the knives, a pair of overhead opening elements 71 are fixed to a rotatable shaft 72 which rotates in timed relation to the feed of the cartons and the reciprocation of the knives. The opening elements project radially from one side of the shaft 72 so that the carton blanks may pass underneath the elements when they are in their raised position. As the elements rotate counterclockwise, as viewed in FIG. 6, a surface 73 of the elements 71 engages the trailing side panel 13 of the blanks to swing it to a substantially vertical position. The carton blank in this attitude overlies a transport conveyor 75 which includes laterally spaced trailing transport lugs. The transport lugs 76 move in timed relation to the opening elements so that when the trailing side panel of the blank is raised to the vertical orientation, the trailing transport lugs 76 swing upwardly into engagement with the trailing side panel and move the carton blank out of the erecting apparatus with the leading side panel in engagement with a leading transport lug 77 of the transport conveyor.

Figure 6:
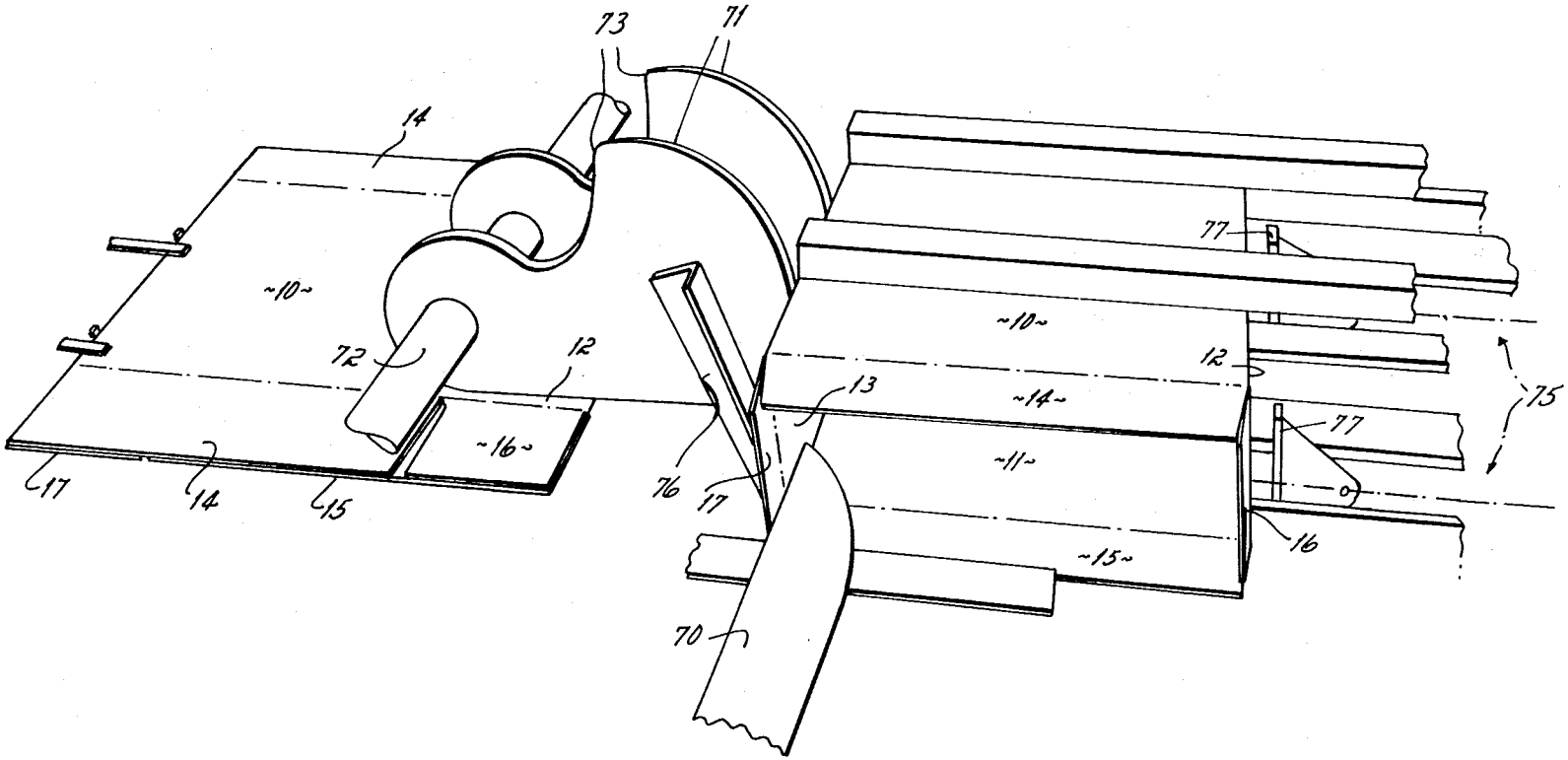
FIG. 6 is a perspective view of an alternative embodiment.

The mechanism of FIG. 6 is generally conventional, being illustrated in U.S. Pat. No. 3,476,024 except for the overhead opening element. The overhead opening element replaces the opening finger and the associated and somewhat complex cam-operating mechanism which is provided for the initial raising of the trailing side panel of the carton in the apparatus of U.S. Pat. No. 3,476,024.

I claim:

1. Apparatus for opening tubular carton blanks passing through said apparatus for movement toward a transport conveyor, said carton having a top panel, an upwardly-facing leading side panel, a bottom panel and a downwardly-facing trailing side panel all interconnected by creases, comprising:

an endless conveyor having an upstream section and a downstream section;

a transverse breaker bar located between said two sections;

a plurality of transversely spaced suction cups located downstream of said breaker bar;

a transverse shaft overlying said upstream section adjacent said breaker bar and having a radially projecting opening element engageable with said trailing side panel;

a transverse shaft overlying said downstream section and having a radially projecting overbreak element;

and means for rotating said shafts in timed relation to first swing a trailing side panel upwardly with said opening element and then swing said trailing side panel fowardly and downwardly with said overbreak element.

2. Apparatus for erecting tubular carton blanks passing through said apparatus for movement toward a transport conveyor, said carton having a top panel, an upwardly-facing leading side panel, a bottom panel and a downwardly-facing trailing side panel all interconnected by creases, comprising:

an endless belt conveyor having two sections upon which said blanks rest as they are carried toward a transport conveyor, a first transverse shaft overlying the upstream section, said shaft having a radial member terminated in a finger, said finger being engageable with the downwardly-facing trailing side panel to rotate it upwardly through an angle of about 90°, a second transverse shaft overlying the downstream section of said endless belt conveyor, said second shaft having a radial member terminating in a finger for engaging the generally vertically oriented trailing side panel to overfold it through an additional 90°, drive means for rotating said two shafts in timed relation, one shaft being driven in a first direction and the second shaft being driven in the opposite direction, and means for stopping said carton blank momentarily as it is engaged by the finger on said first shaft.

3. Apparatus for erecting tubular carton blanks passing through said apparatus for movement toward a transport conveyor, said carton having a top panel, an upwardly-facing leading side panel, a bottom panel and a downwardly-facing trailing side panel all interconnected by creases, comprising:

a stop projecting into the path of said carton as it moves through said erecting apparatus, said stop being engageable with a suitable flap hinged to said carton panel, means for partially opening said carton, means for fully opening said carton after it has been partially open, said fully opening means including:

a transverse shaft located rearwardly of and above said partial opening means, at least one rotary opening element fixed on said shaft and having a major portion projecting radially from one side of said shaft, means for rotating said shaft in timed relation to a carton arriving at said apparatus, whereby said projecting portion will swing underneath the trailing panel of said carton and swing it upwardly through an arc of at least approximately 90°, and a conveyor for conveying carton blanks past said opening means.

4. Apparatus for erecting tubular carton blanks passing through said apparatus for movement toward a transport conveyor, said carton having a top panel, an upwardly-facing leading side panel, a bottom panel and a downwardly-facing trailing side panel all interconnected by creases, said carton blanks having laterally projecting flaps, comprising:

means for partially opening said carton, a stop projecting into the path of said carton as it moves through said erecting apparatus, plow means depressing the flaps on the leading side panel and said bottom panel, said stop being engageable by the flap on said trailing side panel, said flap being movable out of the path of said stop when said trailing side panel is swung upwardly, and means for fully opening said carton after it has been partially open, said fully opening means including:

a transverse shaft located rearwardly of and above said partial opening means, at least one rotary opening element fixed on said shaft and having a major portion projecting radially from one side of said shaft, means for rotating said shaft in timed relation to a carton arriving at said apparatus, whereby said projecting portion will swing underneath the trailing panel of said carton and swing it upwardly through an arc of at least approximately 90°, and a conveyor for conveying carton blanks past said opening means.

5. Apparatus for erecting tubular carton blanks passing through said apparatus for movement toward a transport conveyor, said carton having a top panel, an upwardly-facing leading side panel, a bottom panel and a downwardly-facing trailing side panel all interconnected by creases, comprising:

a transverse breaker bar underlying the path of a carton, at least one suction cup located adjacent said breaker bar, means for applying a vacuum to said suction cup when a carton overlies it to draw the under side of said carton downwardly against said breaker bar, thereby partially opening said carton, means for fully opening said carton after it has been partially open, said fully opening means including:

a transverse shaft located rearwardly of and above said transverse breaker bar, at least one rotary opening element fixed on said shaft and having a major portion projecting radially from one side of said shaft, means for rotating said shaft in timed relation to a carton arriving at said apparatus, whereby said projecting portion will swing underneath the trailing panel of said carton and swing it upwardly through an arc of at least approximately 90°, and a conveyor for conveying carton blanks past said opening means.

6. Apparatus as in claim 5 wherein said tubular carton has flaps hinged to said top, bottom and side panels, said apparatus further comprising stationary horizontal plows positioned alongside the path of said carton, said plows being projectable between flaps associated with the leading and upper panels on the one hand and the trailing and bottom panels on the other hand.

7. Apparatus as in claim 5 in which said suction cup is stationary and has an upwardly projecting lip lying approximately in the plane of the carton bottom panel as it passes through the apparatus, said lip being flexible and collapsing downwardly when a vacuum is applied to it and its engagement with the bottom panel of the carton.

8. Apparatus as in claim 5 further comprising:

stop means in the path of said carton blank to stop the movement of said carton when the crease between said trailing and bottom panels overlies the upper edge of said transverse breaker bar.

9. Apparatus as in claim 5 in which said conveyor comprises:

at least one continuously running, endless belt underlying said carton blanks;

and stop means in the path of said carton blanks to stop said blanks while they are engaged by said rotary opening element.

* * * * *